US011745978B2

(12) United States Patent
Gireddy et al.

(10) Patent No.: US 11,745,978 B2
(45) Date of Patent: Sep. 5, 2023

(54) METHOD AND APPARATUS FOR ELEVATORS TO DETECT CONCEALED OBJECT AND INFORM BUILDING MANAGEMENT SYSTEM

(71) Applicant: OTIS ELEVATOR COMPANY, Farmington, CT (US)

(72) Inventors: Jayapal Reddy Gireddy, Telangana (IN); Devendar Gorenkala, Telangana (IN)

(73) Assignee: OTIS ELEVATOR COMPANY, Farmington, CT (US)

( * ) Notice: Subject to any disclaimer, the term of this patent is extended or adjusted under 35 U.S.C. 154(b) by 1084 days.

(21) Appl. No.: 16/514,140

(22) Filed: Jul. 17, 2019

(65) Prior Publication Data

US 2020/0031617 A1 Jan. 30, 2020

(30) Foreign Application Priority Data

Jul. 25, 2018 (IN) ..... 201811028021

(51) Int. Cl.
*B66B 5/00* (2006.01)
*B66B 13/14* (2006.01)
*B66B 3/00* (2006.01)

(52) U.S. Cl.
CPC ..... *B66B 5/0012* (2013.01); *B66B 3/002* (2013.01); *B66B 13/143* (2013.01); *B66B 2201/4653* (2013.01)

(58) Field of Classification Search
CPC ..... B66B 5/0012; B66B 3/002; B66B 13/143; B66B 2201/4653; B66B 1/02; B66B 1/3423; B66B 5/02
See application file for complete search history.

(56) References Cited

U.S. PATENT DOCUMENTS 4,112,419 A 9/1978 Kinoshita et al.
4,537,287 A 8/1985 Noda et al.
6,342,696 B1 1/2002 Chadwick
6,970,087 B2 11/2005 Stis
(Continued)

FOREIGN PATENT DOCUMENTS

CN 102893184 B 8/2015
CN 105372711 A 3/2016
(Continued)

OTHER PUBLICATIONS

The Extended European Search Report for Application No. 19188482.4-1017; Report dated Dec. 11, 2019; 6 pages.
(Continued)

*Primary Examiner* — Jeffrey Donels
(74) *Attorney, Agent, or Firm* — CANTOR COLBURN LLP

(57) ABSTRACT

A method for object detection within an elevator car including: transmitting radar signals at a selected polarization into an elevator car towards an individual; receiving reflected radar signals at a reflected polarization; comparing the reflected polarization to the selected polarization; determining that the individual is in possession of a metal object in response to comparing the reflected polarization to the selected polarization; and activating an alert in response to the determining that the individual is in possession of the metal object.

18 Claims, 3 Drawing Sheets

(56) References Cited

U.S. PATENT DOCUMENTS

| | | | | |
|---|---|---|---|---|
| 9,382,096 | B2 | 7/2016 | Finschi | |
| 10,822,196 | B2 * | 11/2020 | Fauconnet | B66B 1/3476 |
| 2004/0252024 | A1 | 12/2004 | Huey et al. | |
| 2006/0037818 | A1 | 2/2006 | Deplazes et al. | |
| 2011/0102597 | A1 | 5/2011 | Daly et al. | |
| 2016/0291558 | A1 | 10/2016 | Finn et al. | |
| 2016/0355376 | A1 | 12/2016 | Sonnenmoser et al. | |
| 2017/0275134 | A1 | 9/2017 | Toner et al. | |
| 2018/0067204 | A1 * | 3/2018 | Frizzell | G01S 13/887 |
| 2020/0024103 | A1 * | 1/2020 | Amuduri | B66B 3/00 |

FOREIGN PATENT DOCUMENTS

| | | | |
|---|---|---|---|
| CN | 105270952 | B | 11/2017 |
| EP | 1094024 | A1 | 4/2001 |
| WO | 2007086916 | A2 | 8/2007 |
| WO | 2008013515 | A2 | 1/2008 |
| WO | 2014151965 | A1 | 9/2014 |

OTHER PUBLICATIONS

EP Office Action; Application No. 19188482.4-1017; dated Jan. 11, 2021; 4 pages.

* cited by examiner

METHOD AND APPARATUS FOR ELEVATORS TO DETECT CONCEALED OBJECT AND INFORM BUILDING MANAGEMENT SYSTEM

CROSS-REFERENCE TO RELATED APPLICATIONS

This application claims the benefit of Provisional Indian Application No. 201811028021 filed Jul. 25, 2018, which is incorporated herein by reference in its entirety.

BACKGROUND

The embodiments herein relate to the field of elevator systems, and specifically to a method and apparatus for object detection in an elevator system.

Elevator system convey individuals to various locations within the building, which may create potential safety risks depending on the individual and the security of the building.

BRIEF SUMMARY

According to an embodiment, a method for object detection within an elevator car is provided. The method including: transmitting radar signals at a selected polarization into an elevator car towards an individual; receiving reflected radar signals at a reflected polarization; comparing the reflected polarization to the selected polarization; determining that the individual is in possession of a metal object in response to comparing the reflected polarization to the selected polarization; and activating an alert in response to the determining that the individual is in possession of the metal object.

In addition to one or more of the features described herein, or as an alternative, further embodiments may include capturing an image of the individual in possession of the metal object.

In addition to one or more of the features described herein, or as an alternative, further embodiments may include prior to capturing an image of the individual in possession of the metal object: directing a camera towards the individual.

In addition to one or more of the features described herein, or as an alternative, further embodiments may include that the image is a facial image of the individual in possession of the metal object.

In addition to one or more of the features described herein, or as an alternative, further embodiments may include that the image is transmitted to a building management system.

In addition to one or more of the features described herein, or as an alternative, further embodiments may include: identifying the individual in possession of the metal object through facial recognition.

In addition to one or more of the features described herein, or as an alternative, further embodiments may include: detecting a location of each of a plurality of mobile devices configured to transmit elevator calls to the elevator car; determining that a first mobile device of the plurality of mobile devices is located within the elevator car; and identifying the individual in possession of the metal object as the owner of the first mobile device.

In addition to one or more of the features described herein, or as an alternative, further embodiments may include: transmitting a message to the owner of the first mobile device.

In addition to one or more of the features described herein, or as an alternative, further embodiments may include: determining the individual in possession of the metal object is alone in the elevator car; and locking the doors of the elevator car.

In addition to one or more of the features described herein, or as an alternative, further embodiments may include that the metal object is a gun.

According to another embodiment, an object detection system for detecting an object in an elevator car is provided. The object detection system including: a radar sensor configured to transmit and receive radar signals; a control unit including: a processor; a memory including computer-executable instructions that, when executed by the processor, cause the processor to perform operations, the operations including: transmitting radar signals at a selected polarization into an elevator car towards an individual using the radar sensor; receiving reflected radar signals at a reflected polarization using the radar sensor; comparing the reflected polarization to the selected polarization; determining that the individual is in possession of a metal object in response to comparing the reflected polarization to the selected polarization; and activating an alert in response to the determining that the individual is in possession of the metal object.

In addition to one or more of the features described herein, or as an alternative, further embodiments may include: a camera configure to capture an image of the individual in possession of the metal object.

In addition to one or more of the features described herein, or as an alternative, further embodiments may include that the operations further include: directing a camera towards the individual.

In addition to one or more of the features described herein, or as an alternative, further embodiments may include that the image is a facial image of the individual in possession of the metal object.

In addition to one or more of the features described herein, or as an alternative, further embodiments may include that the image is transmitted to a building management system.

In addition to one or more of the features described herein, or as an alternative, further embodiments may include that the operations further include: identifying the individual in possession of the metal object through facial recognition.

In addition to one or more of the features described herein, or as an alternative, further embodiments may include that the operations further include: detecting a location of each of a plurality of mobile devices configured to transmit elevator calls to the elevator car; determining that a first mobile device of the plurality of mobile devices is located within the elevator car; and identifying the individual in possession of the metal object as the owner of the first mobile device.

In addition to one or more of the features described herein, or as an alternative, further embodiments may include that the operations further include: transmitting a message to the owner of the first mobile device.

In addition to one or more of the features described herein, or as an alternative, further embodiments may include that the operations further include: determining the individual in possession of the metal object is alone in the elevator car; and locking the doors of the elevator car.

In addition to one or more of the features described herein, or as an alternative, further embodiments may include that the metal object is a gun.

Technical effects of embodiments of the present disclosure include detecting an object being carried by an individual within an elevator using at least one of a camera and a polarimetric radar device.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
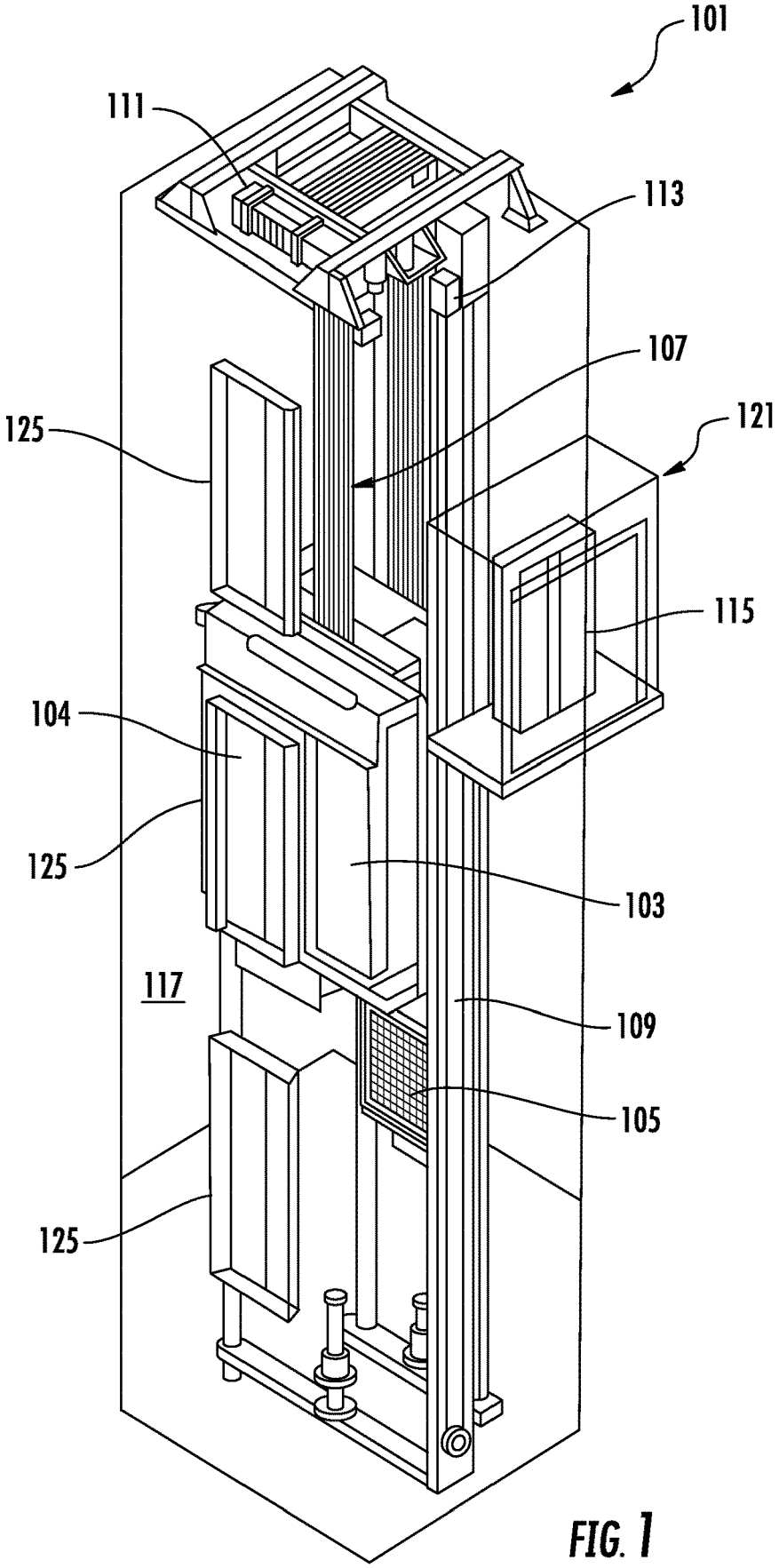
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, a door 104, and a system controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The system controller 115 is located, as shown, in a controller room 121 of the elevator shaft 117 and is configured to control the operation of the elevator system 101, and particularly the elevator car 103. For example, the system controller 115 may provide drive signals to the machine 111 to control the acceleration, deceleration, leveling, stopping, etc. of the elevator car 103. The system controller 115 may also be configured to receive position signals from the position reference system 113 or any other desired position reference device. When moving up or down within the elevator shaft 117 along guide rail 109, the elevator car 103 may stop at one or more landings 125 as controlled by the system controller 115. Although shown in a controller room 121, those of skill in the art will appreciate that the controller 115 can be located and/or configured in other locations or positions within the elevator system 101. In one embodiment, the system controller 115 may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

In other embodiments, the system comprises a conveyance system that moves passengers between floors and/or along a single floor. Such conveyance systems may include escalators systems, moving walkways, metro systems (e.g., subway systems), train systems, conveyer systems, production lines, people movers, etc. Accordingly, embodiments described herein are not limited to elevator systems, such as that shown in FIG. 1. In one example, embodiments disclosed herein may be applicable conveyance systems such as an elevator system 101 and a conveyance system component such as an elevator car 103 of the elevator system 101. In another example, embodiments disclosed herein may be applicable conveyance systems such as an escalator system and a conveyance system component such as a moving stair of the escalator system.

Figure 2:
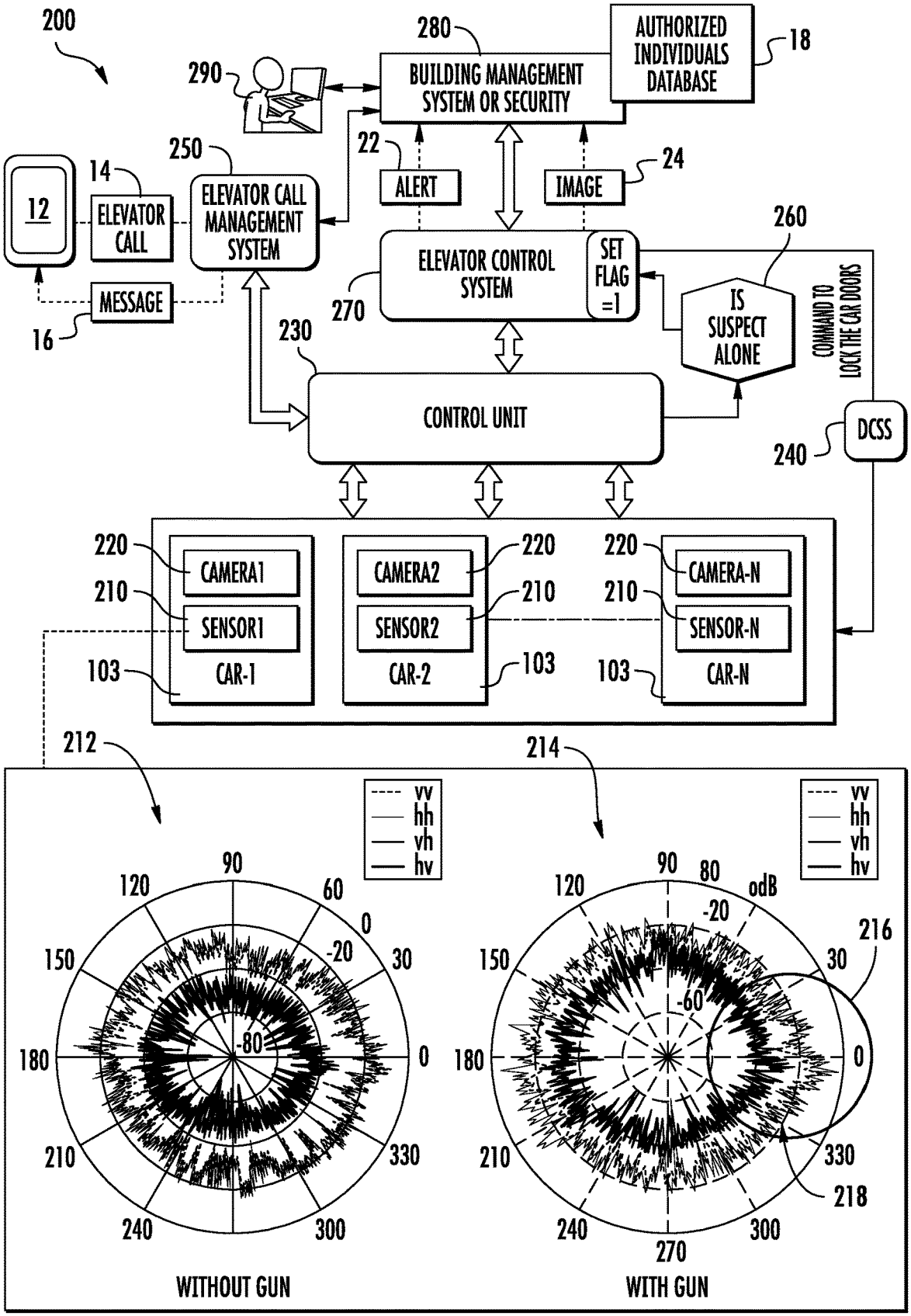
FIG. 2 is a schematic illustration of an object detection system for use with one or more of the elevator system of FIG. 1, in accordance with an embodiment of the disclosure.

FIG. 2 is a view of an object detection system 200 that may include a control unit 230, a camera 220, and a radar sensor 210. The object detection system 200 may serve one or more elevator cars 103, as shown in FIG. 2. Although only one camera 220 is illustrated in each elevator car 103, one or more cameras 220 may be present in each elevator car 103. The camera is configured to capture images 24 of the inside of the elevator car 103 and may be a still image camera, video camera, digital camera, or any other camera known to one of skill in the art. Although only one radar sensor 210 is illustrated in each elevator car 103, one or more radar sensors 210 may be present in each elevator car 103. The object detection system 200 may be in communication with other existing building systems including but not limited to an elevator control system 270, an elevator call management system 250, and a door control subsystem (DCSS) 240. It is understood that the object detection system 200 may also include the elevator control system 270, the elevator call management system 250, and the DCSS 240. It should be appreciated that, although particular systems are separately defined in the schematic block diagrams, each or any of the systems may be otherwise combined or separated via hardware and/or software.

The elevator control system 270 may be in communication with each individual elevator controller 115 and coordinate the operation of each individual elevator car 103. The DCSS may coordinate the operation of the doors 104 of each elevator car 103. The elevator call management system 250 may receive, process, and direct elevator calls 14 to the elevator control system 270. The building management system 280 may be an overall building security system consisting various building devices, such as for example, security cameras, door locks, fire alarms, smoke detectors, etc. The building management system may be communication with a building management device 290 configured to allow a security/building employees to view and analyze the status of the building management system 280. The building management device 290 may be a computing device, such as, for example, a desktop computer. The building management device 290 may also be a mobile computing device that is typically carried by a person, such as, for example a smartphone, PDA, smartwatch, tablet, laptop, etc. The building management device 290 may also be two or more separate devices that are synced together, such as, for example, a cellular phone and a desktop computer synced over an internet connection.

The control unit 230 is configured to control the operation of the object detection system 200 and coordinate of the flow of data, alerts 22, and images 24 between the object detection system 200 and other building systems including but not limited to the elevator control system 270, the elevator call management system 250, and the DCSS 240. In an embodiment, the object detection system 200 may include the elevator control system 270, the elevator call management system 250, and the DCSS 240.

The radar sensor 210 is configured to transmit radar signals into the elevator car 103 and detect the reflected radar signals. In an embodiment, the radar sensor 210 utilizes radar signals to detect whether an individual in the elevator car 103 is carrying (or in possession of) an object 218 (e.g., a weapon, knife, firearm, gun). The radar sensor 210 may compare stock cross-sectional radar signatures 212 of a generic individual to the cross-sectional radar signatures 214 of the individual currently in the elevator car 103 to determine whether or not the individual is in possession of an object 218. For example, the radar signals may be utilized to detect whether an individual is in possession of an object 218 that is a weapon (e.g., a gun) by detecting unusual weapon shaped bulges 216 on the hip, on the leg, or in a bag. The reflected radar signatures may be analyzed by the radar sensor 210 and/or the control unit 230.

In an embodiment, the radar sensor 210 is a polarimetric radar configured to transmit radar signals at a particular or selected polarization. The polarimetric radar may utilize motion capture techniques to identify the reflected signals from the limbs and torso of a human walking (i.e., gate of a human, or "the DNA of walking"). The polarimetric radar may send out a signal at a selected polarization and analyze the polarization of the signal that is reflected back (i.e., reflected polarization). An irregular metal object 218 (e.g., a metal gun) can change the polarization of the radar signal, allowing for the detection of concealed metal objects 218.

Once an object 218 is detected an alert 22 may be transmitted to the building management system 280 to alert a user of the building management device 290. Once an object 218 is detected, the control unit may direct the camera 220 towards the individual in possession of the object 218 and then the camera 220 may capture an image 24 (i.e., photo) of the individual. The image 24 may be specifically of the face of the individual, so that facial recognition may be performed on the facial image 24 of the individual. The image 24 of the individual may also be transmitted to building management system 280 to alert a user of the building management device 290.

The individual in possession of the object 218 may also be identified utilizing the elevator call management system 250 to identify the mobile device 12 of the individual in possession of the object 218 in the elevator car 103. For example, the elevator call management system 250 is configured to received elevator calls 14 from an application on a mobile device 12 belonging to the individual and thus through the application on the mobile device 12, the location of each individual can be identified by finding the location each mobile device 12 utilizing the elevator call management system 250 and the individual in the elevator car 103 can be pinpointed by identifying the individual who has a mobile device 12 located within the elevator car 103. The mobile device 12 may be a mobile computing device that is typically carried by a person, such as, for example a smartphone, PDA, smartwatch, tablet, laptop, etc. GPS on the mobile device may be utilized to locate the mobile device 12. Triangulation of cellular signals and/or short-range wireless signals (e.g., Bluetooth, Wi-Fi) may also be utilized to located the mobile device 12. Advantageously, if the individual in possession of the object 218 is identified through the elevator call management system 250, then the elevator call management system 250 may communicate with the individual. For example, the elevator call management system 250 may transmit a message 16 to the individual through the application on the mobile device 12 that requests that the individual turn the object 218 (e.g., gun) into security or the elevator call management system 250 may transmit a message 16 to the individual through the application on the mobile device 12 that informs the individual that "this is a gun free zone and any guns must be removed from the premises".

Also advantageously, if the individual in possession of the object 218 is identified through the elevator call management system 250 or facial recognition, it may also be verified through an authorized individuals database 18 (e.g., that may be stored in the building management system 280) that the individual in possession of the object 218 is authorized to carry the object 218, thus the alert 22 may be cancelled. For example, the object detection system 200 may identify that a security guard is carrying a gun in the elevator car 103 by checking the authorized individuals database 18, the object detection system 200 can prevent a false alarm.

At least one of the radar sensor 210 and the camera 220 may determine how many individuals are located within the elevator car 103. At 260, if the individual identified as in possession of an object is alone in the elevator car 103, then the elevator control system 270 may instruct the DCSS 240 to lock the doors 104 of the elevator car 103, thus preventing the individual from escaping the elevator car 103 until security or the police have arrived.

Figure 3:
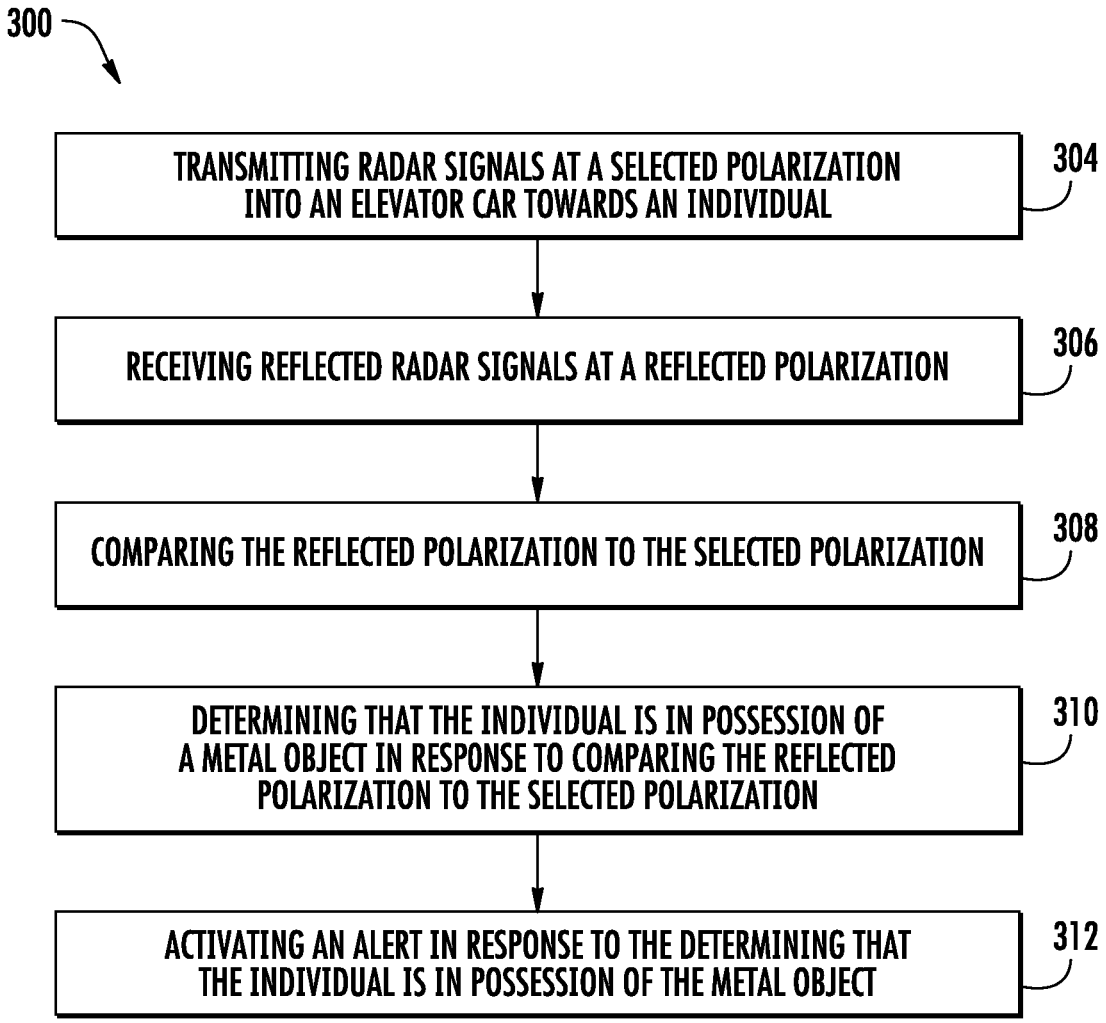
FIG. 3 is a flow chart of a method for object detection within an elevator car, in accordance with an embodiment of the disclosure.

Referring now to FIG. 3, while referencing components of FIGS. 1-2. FIG. 3 shows a flow chart of a method 300 for object 218 detection within an elevator car 103, in accordance with an embodiment of the disclosure. At block 304, radar signals are transmitted at a selected polarization into an elevator car 103 towards an individual. At block 306, reflected radar signals are received at a reflected polarization. At block 308, the reflected polarization is compared to the selected polarization. At block 310, is it determined that the individual is in possession of a metal object 218 in response to comparing the reflected polarization to the selected polarization. For example, the reflected polarization may differ from the select polarization indicating that a metal object 218 is present. In an embodiment, the metal object 218 is a firearm, such as, for example a gun. At block 312, an alert 22 is activated in response to the determining that the individual is in possession of the metal object 218. The alert 22 may activate an alarm that is audible, visual, and/or vibratory. The alarm may be activated on the building management device 290.

The method 300 may further comprise: capturing an image 24 of the individual in possession of the metal object 218 using a camera 220, which may have to be directed towards the individual in possession of the object 218 or specifically towards the face of the individual in possession of the object 218. As mentioned above, the image 24 may be transmitted to the building management system 280. As also mentioned above, the image 24 may be used for facial image recognition to identify the individual in possession of the object 218.

The method 300 may further comprise: detecting a location of each of a plurality of mobile devices 12 configured to transmit elevator calls 14 to the elevator car 103 (e.g., through an elevator call management system 250); determining that a first mobile device 12 of the plurality of mobile devices 12 is located within the elevator car 103; and identifying the individual in possession of the metal object 218 as the owner of the first mobile device 12. Once the individual in possession of the metal object 218 is identified as the owner of the first mobile device 12, a message 16 may be transmitted to the owner of the first mobile device 12. The owner of the first mobile device 12 may also be verified as an individual on the authorized individual list 18 and is authorized to carry the metal object 218 (e.g., a gun), and thus the alert 22 may be deactivated.

The method 300 may further comprise: determining the individual in possession of the metal object 218 is alone in the elevator car 103; and locking the doors 104 of the elevator car 103.

While the above description has described the flow process of FIG. 3 in a particular order, it should be appreciated that unless otherwise specifically required in the attached claims that the ordering of the steps may be varied.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

As described above, embodiments can be in the form of processor-implemented processes and devices for practicing those processes, such as a processor 214 in mobile wireless access point 210. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A method for object detection within an elevator car, the method comprising:

transmitting radar signals at a selected polarization into an elevator car towards an individual;

receiving reflected radar signals at a reflected polarization;

comparing the reflected polarization to the selected polarization;

determining that the individual is in possession of a metal object in response to comparing the reflected polarization to the selected polarization; and activating an alert in response to the determining that the individual is in possession of the metal object;

detecting a location of each of a plurality of mobile devices configured to transmit elevator calls to the elevator car;

determining that a first mobile device of the plurality of mobile devices is located within the elevator car; and identifying the individual in possession of the metal object as the owner of the first mobile device.

2. The method of claim 1, further comprising, capturing an image of the individual in possession of the metal object.

3. The method of claim 2, further comprising prior to capturing an image of the individual in possession of the metal object:

directing a camera towards the individual.

4. The method of claim 2, wherein the image is a facial image of the individual in possession of the metal object.

5. The method of claim 2, wherein the image is transmitted to a building management system.

6. The method of claim 4, further comprising:

identifying the individual in possession of the metal object through facial recognition.

7. The method of claim 1, further comprising:

transmitting a message to the owner of the first mobile device.

8. The method of claim 1, further comprising:

determining the individual in possession of the metal object is alone in the elevator car; and locking the doors of the elevator car.

9. The method of claim 1, wherein the metal object is a gun.

10. An object detection system for detecting an object in an elevator car, comprising:

a radar sensor configured to transmit and receive radar signals;

a control unit comprising:

a processor;

a memory comprising computer-executable instructions that, when executed by the processor, cause the processor to perform operations, the operations comprising:

transmitting radar signals at a selected polarization into an elevator car towards an individual using the radar sensor;

receiving reflected radar signals at a reflected polarization using the radar sensor;

comparing the reflected polarization to the selected polarization;

determining that the individual is in possession of a metal object in response to comparing the reflected polarization to the selected polarization;

activating an alert in response to the determining that the individual is in possession of the metal object;

detecting a location of each of a plurality of mobile devices configured to transmit elevator calls to the elevator car;

determining that a first mobile device of the plurality of mobile devices is located within the elevator car; and identifying the individual in possession of the metal object as the owner of the first mobile device.

11. The object detection system of claim 10, further comprising:

a camera configure to capture an image of the individual in possession of the metal object.

12. The object detection system of claim 11, wherein the operations further comprise:

directing a camera towards the individual.

13. The object detection system of claim 11, wherein the image is a facial image of the individual in possession of the metal object.

14. The object detection system of claim 11, wherein the image is transmitted to a building management system.

15. The object detection system of claim 13, wherein the operations further comprise:

identifying the individual in possession of the metal object through facial recognition.

16. The object detection system of claim 10, wherein the operations further comprise:

transmitting a message to the owner of the first mobile device.

17. The object detection system of claim 10, wherein the operations further comprise:

determining the individual in possession of the metal object is alone in the elevator car; and locking the doors of the elevator car.

18. The object detection system of claim 10, wherein the metal object is a gun.

* * * * *